United States Patent [19]

Eibich

[11] 4,417,406

[45] Nov. 29, 1983

[54] ARRANGEMENT FOR DRYING PLATE-SHAPED WOOD PRODUCTS

[75] Inventor: Peter Eibich, Bad Hersfeld, Fed. Rep. of Germany

[73] Assignee: Babcock-BSH Aktiengesellschaft, Krefeld, Fed. Rep. of Germany

[21] Appl. No.: 290,793

[22] Filed: Aug. 3, 1981

[30] Foreign Application Priority Data

Aug. 9, 1980 [DE] Fed. Rep. of Germany ..... 3030272

[51] Int. Cl.[3] ..... F26B 13/04

[52] U.S. Cl. ..... 34/155; 34/207; 34/216; 34/217

[58] Field of Search ..... 34/210, 211, 212, 213, 34/214, 215, 216, 217, 207, 208, 155; 198/435, 611

[56] References Cited

U.S. PATENT DOCUMENTS

| | | | |
|---|---|---|---|
| 2,579,814 | 12/1951 | Genest et al. | 198/611 |
| 2,758,386 | 8/1956 | Cobb | 34/213 |
| 3,164,239 | 1/1965 | Reed | 198/611 |
| 3,353,652 | 11/1967 | Fellner, Jr. | 198/611 |
| 3,371,585 | 3/1968 | Moser et al. | 198/611 |
| 3,474,544 | 10/1969 | Holden, Jr. et al. | 34/216 |
| 3,705,001 | 12/1972 | Ling et al. | 198/611 |

FOREIGN PATENT DOCUMENTS

| | | | |
|---|---|---|---|
| 604844 | 10/1934 | Fed. Rep. of Germany | 34/217 |
| 630132 | 5/1936 | Fed. Rep. of Germany . | |
| 758580 | 4/1952 | Fed. Rep. of Germany . | |

*Primary Examiner*—Larry I. Schwartz
*Attorney, Agent, or Firm*—Michael J. Striker

[57] ABSTRACT

An arrangement for drying plate-shaped wood products, such as veneers and plywood plies, includes a roller conveyor which advances the products in the leading portion of their drying path, and a belt conveyor which advances the products in the trailing portion of such path. The two conveyors are accommodated in separate housings. The roller conveyor includes a plurality of pairs of rollers which confine the wood products therebetween and thus smoothen the same, while the belt conveyor includes at least two conveyor belts which confine the wood products between themselves but do not interfere with the shrinking of the material of the products as the same are being dried. A transition or transfer device, such as a roller table, is arranged between and aligned with the roller and belt conveyors to let the material of the plate-shaped wood product get rid of the stresses which have built up therein during its passage through the roller conveyor section. The length ratio of the roller and belt conveyors is in the range of between 1:2 and 2:1.

6 Claims, 1 Drawing Figure

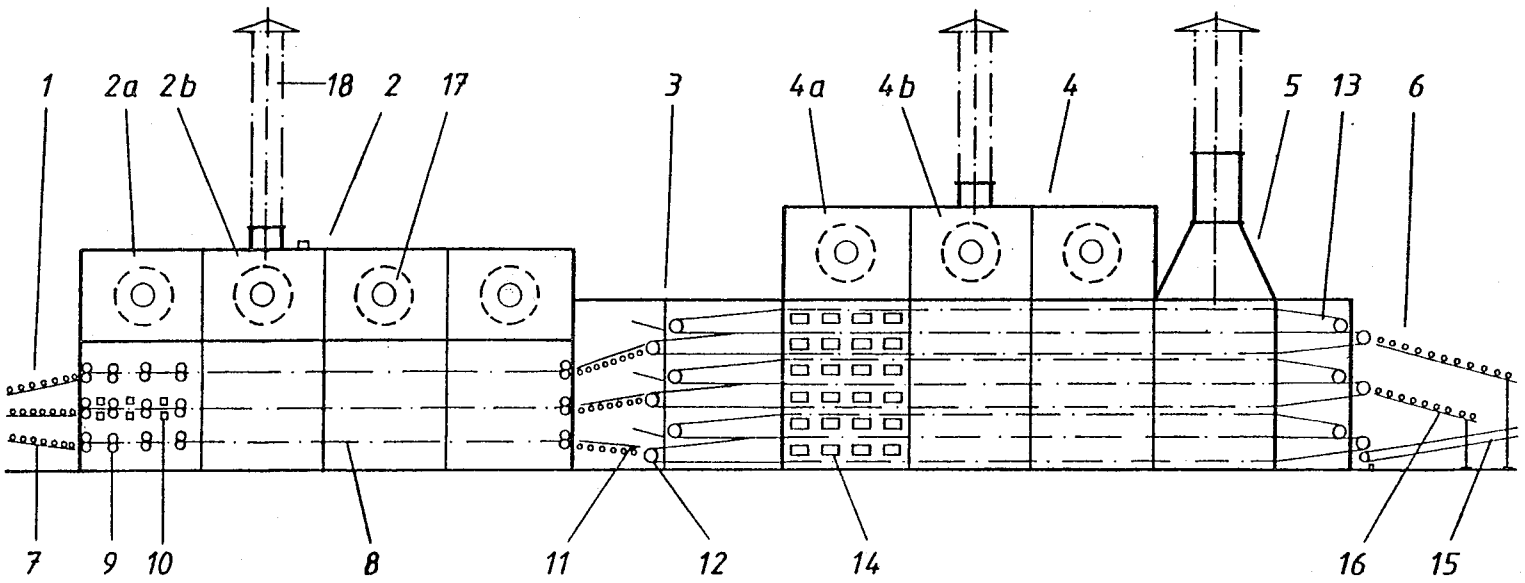
6
13
5
4
4b
4a
3
17
2
18
2b
2a
1
15
16
14
12
11
8
10
9
7

ARRANGEMENT FOR DRYING PLATE-SHAPED WOOD PRODUCTS

BACKGROUND OF THE INVENTION

The present invention relates to arrangements for drying plate-shaped wood products in general, and more particularly to arrangements for drying veneers, plywood plies and the like.

There are already known various constructions of drying arrangements for plate-shaped wood products, among them such which are capable of drying the wood products in a continuous operation during the passage of such products through the respective drying arrangement.

In drying arrangements of this type, the plate-shaped wood products have to be supported and advanced during their passage through the drying arrangement in such a manner as to assure effective drying of such products, on the one hand, and to prevent deformation of and/or development of undue stresses in such wood products during their drying, on the other hand.

The known continuously operating drying arrangements are usually constructed either as roller driers or as belt driers. The roller drier utilizes as its supporting and advancing means a series of pairs of cooperating rollers distributed over the length of the drying arrangement. Then, the plate-shaped wood products are advanced through the drier between the upper and the lower roller of the respective roller pairs. An advantage of the roller drier resides in the fact that, because of the adjustable line pressure existing between the upper and the lower roller of the respective roller pair, the plate-shaped wood product is kept planar.

However, the roller drier is not particularly suited for drying relatively thin, wet wood products, which have only limited stiffness. More particularly, inasmuch as there is provided no guidance for the wood product between the two adjacent roller pairs, a secure transfer of the wood product from one roller pair to the other is not assured.

Belt driers are better suited for thin plate-shaped or sheet-shaped wood products, such as veneers. In such driers, the thin plate-shaped wood products are advanced in the desired path through the drier between the lower run of an upper belt conveyor and the upper run of a lower belt conveyor. In this construction, the guidance of the wood products is unproblematical. As a result of the resting of part of the weight of the upper conveyor belt on the wood product, there is even obtained a certain smoothing effect, which may be sufficient for thinner plate-shaped wood products. Naturally, this smoothing action is considerably less pronounced than that occurring in roller driers.

A drier for wood products which combines the roller and belt conveyors along the path of passage of the wood products through the drying arrangement is known from the German Pat. No. 758,580. In this conventional construction, the belt conveyor section is arranged at the upstream, and the roller conveyor section at the downstream, portion of the path. One of the purposes of this arrangement of the conveyors is to also utilize the advantageous smoothing action of the rollers of the roller conveyor for thinner plate-shaped wood product. More particularly, it was established that, after a certain pre-drying, even the relatively thin plate-shaped or sheet-shaped wood products possess a sufficient degree of stiffness, so that they can be advanced through and by the roller conveyor, without encountering any problems.

The present invention is concerned predominantly with those problems which arise when relatively thick plate-shaped wood product, especially peeled veneers or plies of, for instance, poplar wood, which are frequently being used as the internal plies in the manufacture of plywood, are to be dried. Plies or veneers of this kind have previously been dried almost exclusively in roller driers. However, difficulties are often encountered when this approach is taken, especially when the wood products are to be dried to a final moisture contents of approximately between 1 and 3%. This is attributable to the fact that the pressure exerted by the rollers on the wood products during the drying operation interferes with the ability of the wood product material to shrink. Owing to this interference, shrinking stresses develop in the wood product material, which often result in the development of cracks in or other destruction of the wood products.

The German Pat. No. 630,132 deals with this problem as encountered in roller conveyors. In this arrangement, the roller conveyor has roller pairs only along a short stretch of the path of passage of the plate-shaped wood products through the drier, at the leading end of this path. Each of the roller pairs includes an upper roller and a lower roller, and one of the main purposes of such roller pairs is to securely draw the plate-shaped wood products into the drier and to assure their proper progression through the drying arrangement. On the other hand, along the predominating part of the path, the length of which as considered in the advancement direction is a multiple of the length of the introducing section of the path flanked by the rollers of the roller pairs, there are disposed only single rollers which merely support the plate-shaped wood product from below. In the drier of this construction, the smoothing action of the roller pairs in the introducing section is quite insignificant, particularly in view of the relatively small length of the introducing section, while no smoothing action whatsoever takes place in the main section where the wood product is merely loosely supported from below by the single rollers.

SUMMARY OF THE INVENTION

Accordingly, it is a general object of the present invention to avoid the disadvantages of the prior art.

More particularly, it is an object of the invention to provide a drying arrangement for drying plate-shaped or sheet-shaped wood products, such as veneers and plywood plies, which is not possessed of the disadvantages of the conventional drying arrangements of this type.

A further object of the invention is to so construct the drying arrangement of the type here under consideration as to be able to handle relatively thick plate-shaped wood products, such as peeled veneers or plies of poplar wood, to subject the same to a sufficient smoothing action, and to dry the same even to a relatively low moisture contents without running the risk of developing the feared undue stresses and/or cracks therein.

An additional object of the present invention is to so design the arrangement as to be relatively simple in construction, inexpensive to manufacture, and reliable in operation nevertheless.

In pursuance of these objects and others which will become apparent hereafter, one feature of the present invention resides in an arrangement for drying plate-shaped wood products, especially veneers and plywood plies, in a continuous operation during their passage in a predetermined path through the drying arrangement, briefly stated, in a combination comprising means for advancing the products in an upstream portion of the path, including a roller conveyor; and means for advancing the products in a downstream portion of the path, including a belt conveyor. Advantageously, the roller conveyor includes a plurality of pairs of rollers, the rollers of each pair confining the respective wood product between themselves, and the belt conveyor includes at least one pair of conveyor belts confining the respective wood product between themselves.

When the drying arrangement is constructed in the above-mentioned manner, there is obtained the advantage that the plate-shaped wood products are held perfectly planar during their advancement through the upstream portion of their path, due to the pressing action of the roller pairs thereon. Thereafter, the plate-shaped wood products are released from the confining action of the roller pairs and are further advanced, in a protective manner, in the downstream portion of the path, between the support conveyor belt and the covering conveyor belt. Thus, during their advancement in the downstream portion of the path, the respective plate-shaped wood products can shrink without any hindrance and, due to the cooperation of the conveyor belts therewith, they are subjected to an additional smoothing action.

Advantageously, the drying arrangement according to the present invention further comprises means for supporting the plate-shaped wood products during their transfer from the roller conveyor to the belt conveyor, especially a roller table extending between the conveyors. In this manner, the material of the wood products gets a chance during this transition to get rid of the tensions which have built up therein during the passage of the respective wood product between the rollers of the roller pairs of the roller conveyor.

According to a further advantagous concept of the present invention, the drying arrangement further comprises a separate housing for each of the conveyors. This feature of the present invention facilitates the control of the drying operation, in that the respective plate-shaped wood product is being dried during advancement between the rollers of the roller pairs of the roller conveyor only to such a moisture contents that the shrinking stresses occurring in the material of the respective wood product are below the level at which they would cause destruction of or damage to the material of the product.

The proportion of the lengths of the two conveyors, as seen in the advancement direction, with respect to one another, is determined by the properties and type of the wood material of the plate-shaped wood products to be dried in the drying arrangement. Advantageously, however, this proportion is in the range of between 1:2 and 2:1. The expression "length" as used herein refers to the effective length of the respective conveyor, that is, the length which is accommodated in the interior of the respective housing.

The novel features which are considered as characteristic of the invention are set forth in particular in the appended claims. The improved drying arrangement, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The sole FIGURE of the drawing is a diagrammatic side elevational view of a drying arrangement embodying the present invention.

DETAILED DESCRIPTION OF THE PREFERRED EMBODIMENT

Referring now to the drawing in detail, it may be seen that the drying arrangement of the present invention includes several sections which are arranged downstream of one another as considered in the direction of passage of the wood products therethrough. As illustrated, the drying arrangement also has several tiers so as to be able to simultaneously treat several wood products at vertically spaced levels. However, this is only a space and energy saving expedient, as well as a way to reduce the per product investment and operating costs, and the present invention is not limited to used in such a multi-tier drying machine.

The aforementioned sections include a feeding section 1, a pre-drying section 2, a transfer section 3, and a final drying section 4, which are followed by a cooling section 5 and a collecting or storing section 6. As mentioned above, the drying machine is constructed as a three-tier machine, so that all components thereof are present in each of the sections 1 to 6 in triplicate. So, for instance, the feeding section 1 includes three feeding roller tables 7 which are arranged one above the other. Each of the roller tables 7 is associated with one of three roller conveyors 8 which are also arranged upwardly of one another, in the pre-drying section 2. Each of the roller conveyors 8 includes, in a well known manner, a plurality of roller pairs 9 which are distributed at small mutual distances over the entire length of the pre-drying section 2. However, to simplify the drawing, the cooperating roller pairs 9 have been illustrated only at the entrance end of the pre-drying section 2.

Jet boxes 10 are disposed between the respectively adjacent roller pairs 9 at the two sides of the advancement plane of the wood products to be dried. Here again, in order to avoid cluttering or the drawings, such jet boxes 10 have been illustrated only for the middle-tier roller conveyor 8. The jet boxes 10 are of a conventional construction so that they or their function need not be discussed herein in any detail.

Similarly to the feeding section 1, the transfer section 3 consists of three roller tables 11 which are arranged at three vertically spaced levels again. Leading portions of support conveyor belts 12, which extend frontwardly out of the final drying section 4, adjoin their respectively associated roller tables 11. The conveyor belts 12, together with the respectively associated cover conveyor belts 13, form the respective belt conveyors of the final drying section 4. Here again, jet boxes 14 of conventional construction and function, are arranged to the two sides of the planes along which the wood products are advanced through the section 4 at the various tiers. Here again, the jet boxes 14 have been illustrated only at the entrance end of the final drying section 4.

The belt conveyors 12, 13 extend beyond the section 4 at its terminal end as well. There, they are adjoined by cooperating components of the discharge and collecting section 6 which, in the illustrated construction, include a conveyor belt 15 which is associated with the lowermost of the belt conveyors 12, 13, and two roller tables 16 which are respectively associated and aligned with the middle and upper belt conveyors 12, 13.

The pre-drying section 2 and the final drying section 4 are constituted by a plurality of parts *2a, 2b* a.s.o., and *4a, 4b* a.s.o. each, which are constructed as structural modules and which are assembled with one another in a modular structure. Each of the structural modules or parts *2a, 2b,* etc., and *4a, 4b,* etc. is equipped with a separate blower 17 which serves for circulating the air, and with a heating unit or a plurality of such heating units which is or are totally conventional and thus has or have not been shown in the drawing. The pre-drying section 2, the final drying section 4, and the cooling section 5 are each provided with a stack for discharging gases and vapors from the respective sections 2, 4, and 5. The drying atmosphere in the section 2, as well as that in the section 4, are controllable independently of one another by a control arrangement which does not form a part of the present invention and thus has not been shown in the drawing, and which is capable of controlling the operation of the drying sections 2 and 4.

In a drying machine according to the present invention which is suited for use in an industrial plant, the pre-drying section is, for instance, 10 meters long as considered in the advancement direction of the plate-shaped wood products. Then, the length of the final drying section 4 as considered in the same direction may amount, for instance, to 8 meters, as measured between the end wall thereof facing the roller tables 11 and the end wall facing the belt conveyor 15 and the roller tables 16. Under these circumstances, the ratio of the lengths of the sections 2 and 4 with respect to one another is 1.25:1.

It will be understood that each of the elements described above, or two or more together, may also find a useful application in other types or arrangements differing from the type described above.

While the invention has been illustrated and described as embodied in an arrangement for drying plate-shaped wood products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. In an arrangement for drying plate-shaped wood products, especially veneers and plywood plies, in a continuous operation during their passage in a predetermined path through the drying arrangement, a combination comprising means for advancing the products in an upstream drying portion of the path, including a roller conveyor which has a plurality of pairs of rollers arranged so that the rollers of each pair confine the respective wood product between themselves during advancement; first drying means for partially drying the respective product in the upstream drying portion of the path to a moisture content less than that at which cracking of the product would occur; means for advancing the wood products in a downstream drying portion of the path, including a belt conveyor which has at least one pair of conveyor belts having a support conveyor belt and a cover conveyor belt confining the respective wood product between themselves during advancement so as to allow for shrinkage of said product; and second drying means for finishing the drying of the respective product in the downstream drying portion of the path, so that the respective wood products is smoothened during drying both in the upstream drying portion and in the downstream drying portion of the path.

2. The combination as defined in claim 1, wherein said upstream drying portion of said path is a pre-drying portion arranged to pre-dry the products, whereas said downstream drying portion is a final drying portion arranged to finally dry the products.

3. The combination as defined in claim 1, and further comprising means for supporting the wood products during the transfer from said roller conveyor to said belt conveyor for allowing the wood products to compensate tension built up during the passage between the rollers of said roller conveyor.

4. The combination as defined in claim 3, wherein said supporting means includes a roller table arranged to support the wood products only from below.

5. The combination as defined in claim 1, and further comprising a separate housing for each of said conveyors.

6. The combination as defined in claim 1, wherein said conveyors have effective drying lengths which are in proportion of between 1:2 and 2:1 relative to each other.

* * * * *